US007096793B2

(12) United States Patent
Belog

(10) Patent No.: US 7,096,793 B2
(45) Date of Patent: Aug. 29, 2006

(54) PROJECTILE AND RELATED GUN

(76) Inventor: Barry Belog, 51 Allard Avenue, Winnipeg, Manltoha (CA) R3K 0S8

( * ) Notice: Subject to any disclaimer, the term of this patent is extended or adjusted under 35 U.S.C. 154(b) by 0 days.

(21) Appl. No.: 10/992,751

(22) Filed: Nov. 22, 2004

(65) Prior Publication Data

US 2005/0155513 A1 Jul. 21, 2005

Related U.S. Application Data

(60) Provisional application No. 60/536,530, filed on Jan. 15, 2004.

(51) Int. Cl.
*F42B 12/00* (2006.01)

(52) U.S. Cl. ..... 102/516; 124/56; 102/502

(58) Field of Classification Search ..... 124/49
See application file for complete search history.

(56) References Cited

U.S. PATENT DOCUMENTS 4,278,065 A 7/1981 Wales
5,642,723 A 7/1997 Hogan
5,845,629 A * 12/1998 Ratliff ..... 124/56
6,601,780 B1 * 8/2003 Sheng ..... 239/337
6,644,294 B1 * 11/2003 Christensen ..... 124/77
6,668,815 B1 * 12/2003 Fernandez ..... 124/83

* cited by examiner

*Primary Examiner*—Stephen M. Johnson
*Assistant Examiner*—Gabriel J. Klein
(74) *Attorney, Agent, or Firm*—Ryan W. Dupuis; Michael R. Williams; Adrian D. Battison

(57) ABSTRACT

A projectile including a spherical core and a hook or loop outer cover, has an overall diameter, including the cover which is equal to or less than an internal diameter of a 68 caliber paintball gun for use in the gun in place of paintballs. The diameter of the projectile permits gravity fed, drop loading of projectiles into a conventional paintball gun barrel without an compression of the projectile being required whatsoever. The resultant small gap surrounding the projectile within the barrel permits some pressurized gas to escape around the projectile when firing, thus limiting the velocity of the projectile to a safer velocity for closer range use of conventional paintball guns. A gun is also described having a shuttle for pushing a projectile through the barrel thereof by action of a stretched resilient band. The barrel is sized similarly to a conventional 68 caliber paintball gun for firing either paintballs or the projectiles described herein.

13 Claims, 5 Drawing Sheets

PROJECTILE AND RELATED GUN

This application hereby claims the benefit under 35 U.S.C. Section 119(e) of U.S. provisional application 60/536,530 filed Jan. 15, 2004.

FIELD OF THE INVENTION

The present invention relates to a projectile having one of either hook or loop fasteners thereon and a gun suitable for launching the projectile.

BACKGROUND

Paintball is a known game in which guns are provided with a chamber of compressed gas which is selectively released to propel paintball projectiles. Paintball projectiles typically include a spherical shell which is ruptured on impact to release liquid dye contents within the shell. Accordingly the paintball projectiles are not reusable and cause considerable mess upon impact.

U.S. Pat. No. 5,845,629 proposes the use of reusable projectiles having an outer shell with either hook or loop type fasteners thereon which does not rupture nor contains liquid dye therein, but rather is intended to stick to a corresponding hook or loop fastener type target to indicate a hit. In order to project the hook or loop fastener type projectile, due to its textured surface, it is taught by this patent that it is required that the projectile be somewhat larger in diameter that the typical 17 mm internal diameter barrel of commonly available paintball type guns. Accordingly a complex loading system is required to load the projectiles under compression into the barrel. Due to the compression required, jamming of projectiles in the barrel readily occurs.

SUMMARY

According to one aspect of the present invention there is provided a projectile for use with a compressed gas operated gun having a tubular barrel for receiving the projectile and a compressed gas release mechanism for propelling the projectile, the projectile comprising:

a spherical core; and a covering of material having one of hook or loop fasteners thereon which surrounds the spherical core;

the projectile having an overall diameter, including the covering, which is equal to or less than an internal diameter of the tubular barrel of the gun.

The use of projectiles having an overall diameter which is equal or less than the internal diameter of the barrel of the gun permits gravity fed, drop loading of projectiles into the barrel because jamming isn't ever a problem. The resultant small gap surrounding the projectile within the barrel further permits some pressurized gas to escape around the projectile when firing, thus limiting the velocity of the projectile. This permits a considerably safer operation of the gun as the velocity can be reduced from a conventional paintball velocity of approximately 300 feet per second to an actual velocity of approximately 250 feet per second.

The projectile is preferably in combination with a paintball type gun which is adapted for projecting dye-filled 68 caliber paintball projectiles wherein the barrel has an internal diameter of approximately 17 millimeters.

The covering of material may be formed of a plurality of sections extending radially from a common point, each section having a pair of opposing sides which are convex in profile and which converge at an apex at a free end of the respective section spaced from said common point. The sections are preferably formed integrally of a single sheet of material so as to remain attached with one another as they are cut from the single sheet of material. In addition, the sections preferably form an enclosed spherical shape when the apexes are brought together.

The core may have a solid interior formed of rigid material with an overall diameter between 10 millimeters and 12 millimeters, but more preferably approximately 11 millimeters. A resulting overall diameter of the projectile is preferably between 16 millimeters and 17 millimeters. When forming the core of dense plastic, weight of the projectile may be between 0.8 grams and 1.4 grams, but is preferably approximately 1.1 grams.

In alternative embodiments, the core may be formed of solid or hollow resilient material. A denser rubber type resilient material is preferred.

According to a second aspect there is provided a gun comprising:

an elongate tubular barrel extending longitudinally between a loading end and a dispensing end;

a feed aperture in the barrel adjacent the loading end for receiving a projectile;

a shuttle slidable through the barrel for pushing the projectile through the barrel;

a resilient band coupling the shuttle to the dispensing end of the barrel;

a trigger mechanism for selectively holding the shuttle in a cocked adjacent the loading end of the barrel with the resilient band under tension and the feed aperture being located between the shuttle and the dispensing end of the barrel.

Distance along a path which the resilient band follows between the shuttle and a mounting point of the band on the barrel is preferably adjustable in the cocked position for adjusting tension applied to the resilient band.

There may be provided a magazine coupled to the feed aperture comprising an elongate chamber for supporting a plurality of projectiles therein and a spring loader biased towards the barrel for urging the projectiles through the feed aperture into the barrel.

There may be provided a blocker slidably supported in the barrel between the shuttle and the loading end of the barrel, the blocker being biased away from the loading end of the barrel and including a stop member formed thereon which is slidably received within a slot in the barrel, the slot terminating at a point wherein the blocker extends across the feed aperture to prevent entry of further projectiles into the barrel.

When the barrel has an internal diameter substantially equal to a 68 caliber projectile, the gun may be provided in combination with a projectile having a diameter which is equal to or less than 17 millimeters as described above.

BRIEF DESCRIPTION OF THE DRAWINGS

In the accompanying drawings, which illustrate exemplary embodiments of the present invention.

DETAILED DESCRIPTION

Figure 1:
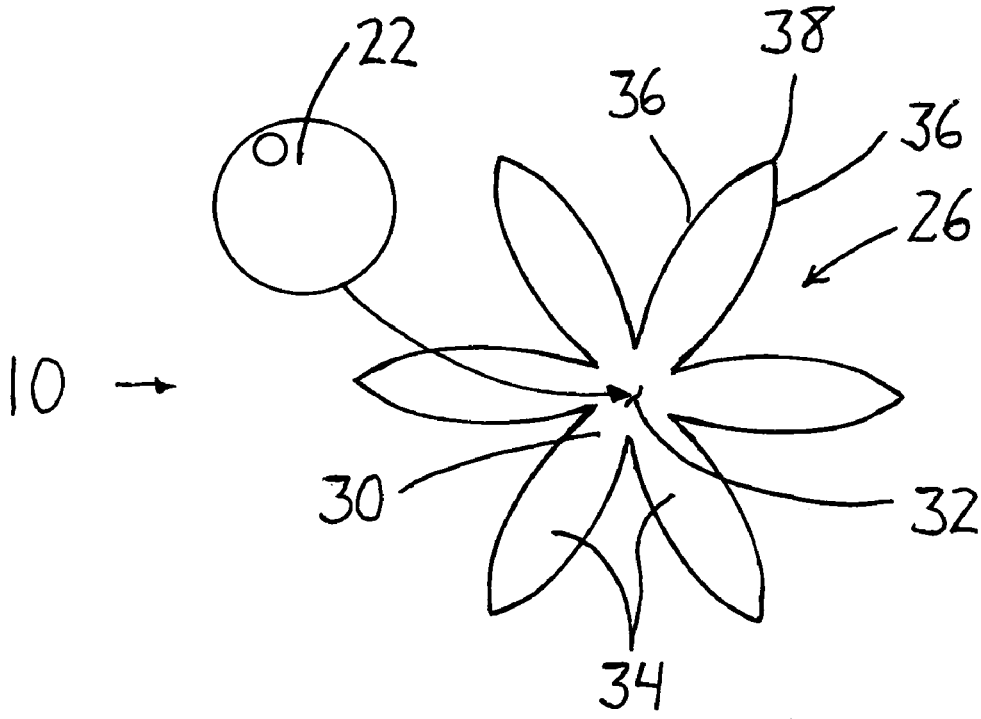
FIG. 1 is an exploded view illustrating the cover removed from the core of the projectile.

Referring to the accompanying drawings, there is illustrated a projectile generally indicated by reference numeral 10. The projectile is suitably arranged for being fed into and launched from a conventional 68 caliber paintball gun 12.

Figure 4:
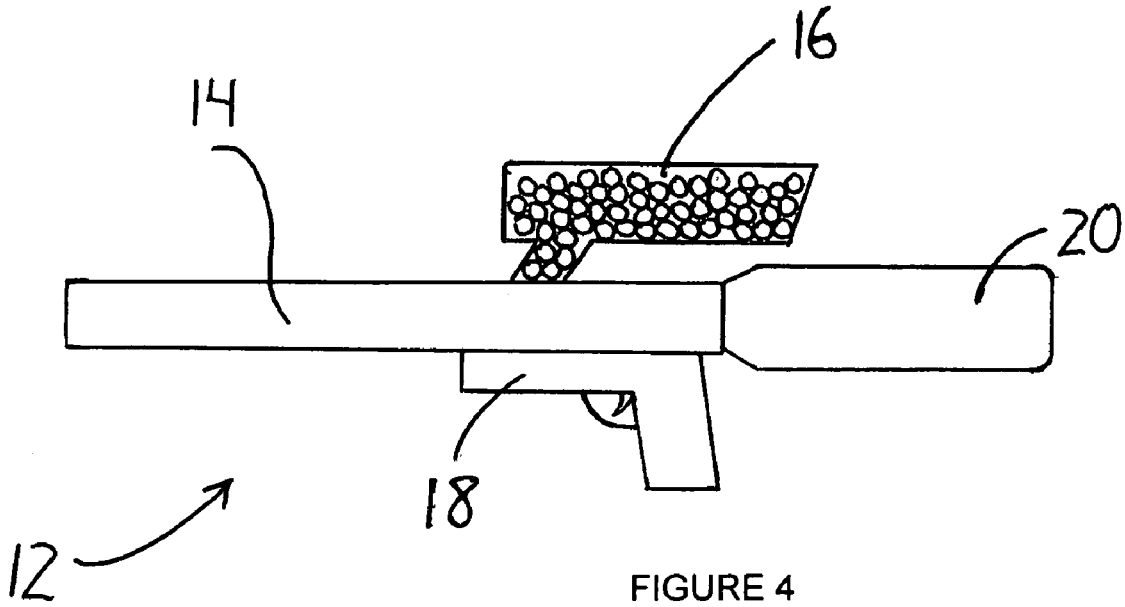
FIG. 4 is a side elevational view of a paintball gun including a gravity fed loader and a compressed air chamber for storing compressed air to be selectively released for launching the projectiles.

As illustrated in FIG. 4 the conventional 68 caliber paintball gun includes a tubular barrel 14 having an internal diameter in the order of 17 mm across. A gravity feed mechanism 16 is mounted above the barrel to permit projectiles to be fed by gravity into the barrel 14. A trigger mechanism 18 controls dispensing of compressed air from a compressed air chamber 20 which stores gas therein under pressure to launch the projectiles when released by the trigger 18. The gun 12 is accordingly arranged for launching conventional paintball projectiles of the type having an outer shell which can be ruptured to release liquid dye content thereof.

The projectile 10 according to the present invention includes a core 22 formed of a rigid dense plastic material formed as a solid bead. Other suitable materials include a dense yet resilient rubber material or other materials having similar properties.

The outer diameter of the bead is approximately 11 mm across. A layer of adhesive 24 surrounds the core 22 for securing a cover 26 to fully surround the core 22. The cover 26 is a single piece of fabric material having loop type fasteners for co-operation with hook type fasteners similar to hook and loop fasteners available under the trademark name Velcro. The cover 26 is oriented with the hook fasteners 28 on an outer side thereof when wrapped about the core 20.

The cover 26, as shown in FIG. 1, is formed in a single piece by being punched from a single sheet of material to form a patterned piece 30 including a centre portion 32 and a plurality of radially extending sections 34 integrally formed with the centre portion and the remaining sections from the single piece of material. Each radial section 34 extends generally radially outwardly from a common point at the centre portion 32 to define opposing sides 36 thereof which are convex in profile and which converge at an apex 38 spaced outwardly from the common point at the centre portion 32.

Figure 2:
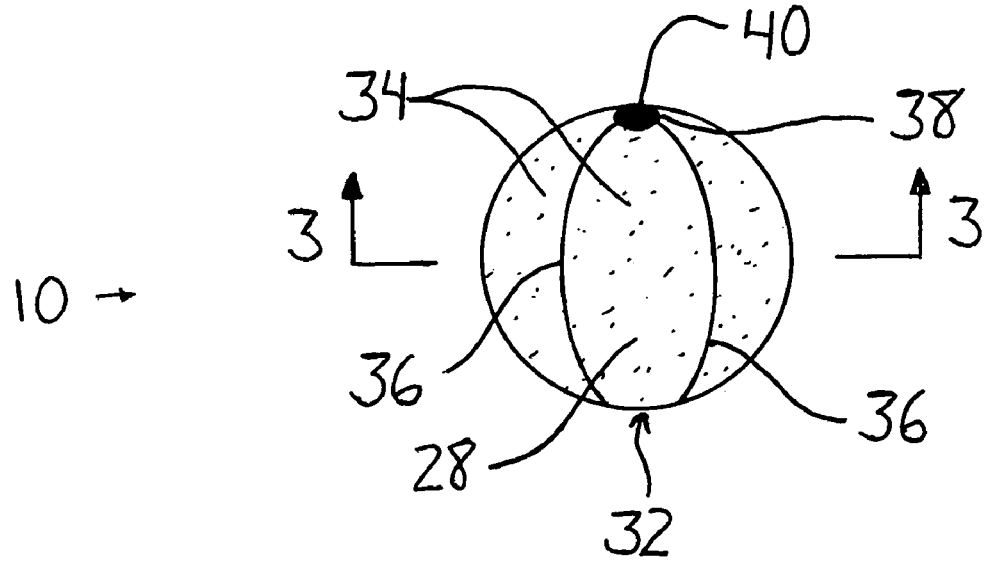
FIG. 2 is a perspective view of the assembled projectile.
Figure 3:
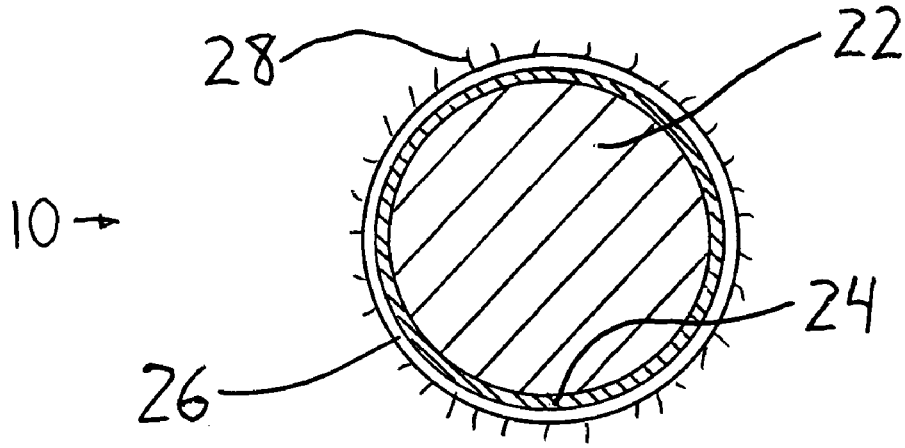
FIG. 3 is a sectional view along the line 3—3 of FIG. 2.

The sections 34 are identical in shape and dimension to one another. Ideally 6 sections are formed so that when the apexes 38 are brought together to a common point diametrically opposite from the common point at the centre portion 32, the single piece of material 30 forms a generally spherical shape which fully surrounds the core 22. A knot 40 is sewn between all of the apexes 38 to ensure that the radial sections 34 remain in the spherical shape illustrated in FIG. 2.

The thickness of the material forming the cover 26 and the layer of adhesive 24 are arranged such that the overall diameter of the projectile including the hook type fasteners 28 of the outer surface of cover is in the order of 16 to 17 mm. Density of the core 22 is selected such that overall weight of the assembled projectile is approximately 1.1 g.

Figure 5:
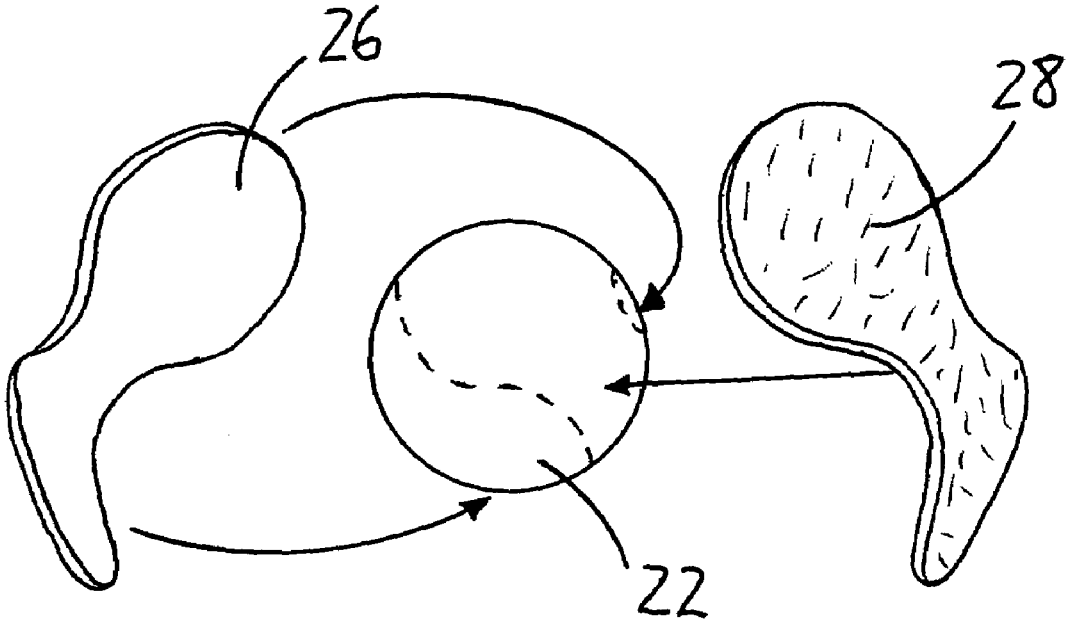
FIG. 5 is an exploded view of a further embodiment of the projectile.
Figure 6:
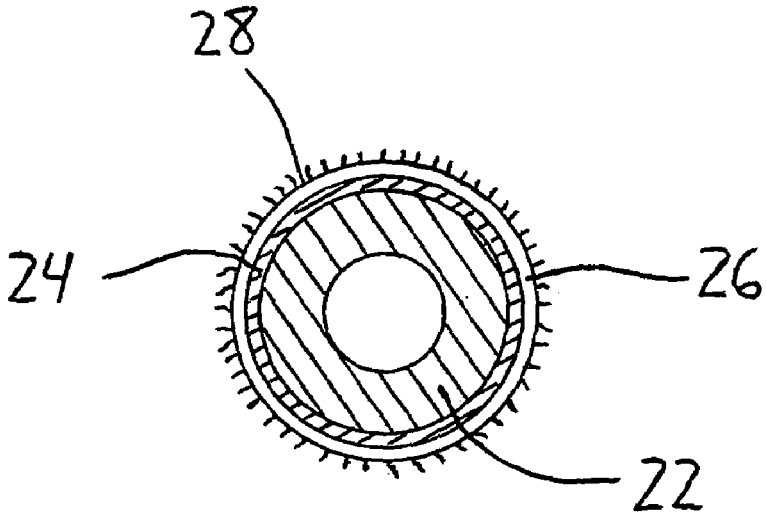
FIG. 6 is a sectional view of the projectile according to FIG. 5.

Turning now to FIGS. 5 and 6, an alternative embodiment of the projectile 10 is illustrated in which the core 22 is formed of a dense and resilient rubber material. The core in this instance is hollow and includes a cover 26 of loop material formed of two identical arcuate halves having a pattern similar to a covering for a baseball or tennis ball. The cover 26 is machine glued resulting in a layer of adhesive 24 similar to the previous embodiment.

Figure 7:
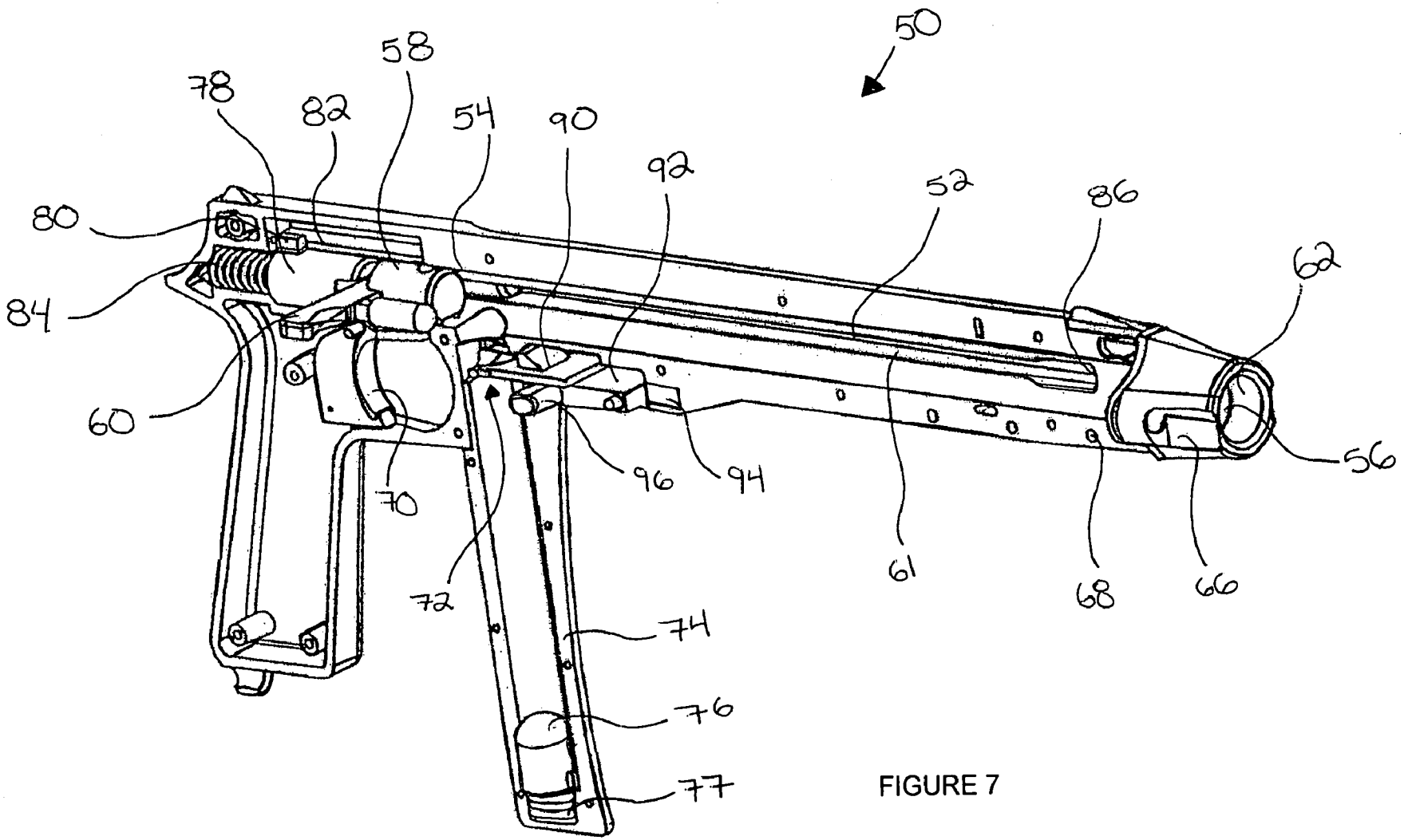
FIG. 7 is a partly sectional perspective view of a related gun suitable for launching the projectiles.
Figure 8:
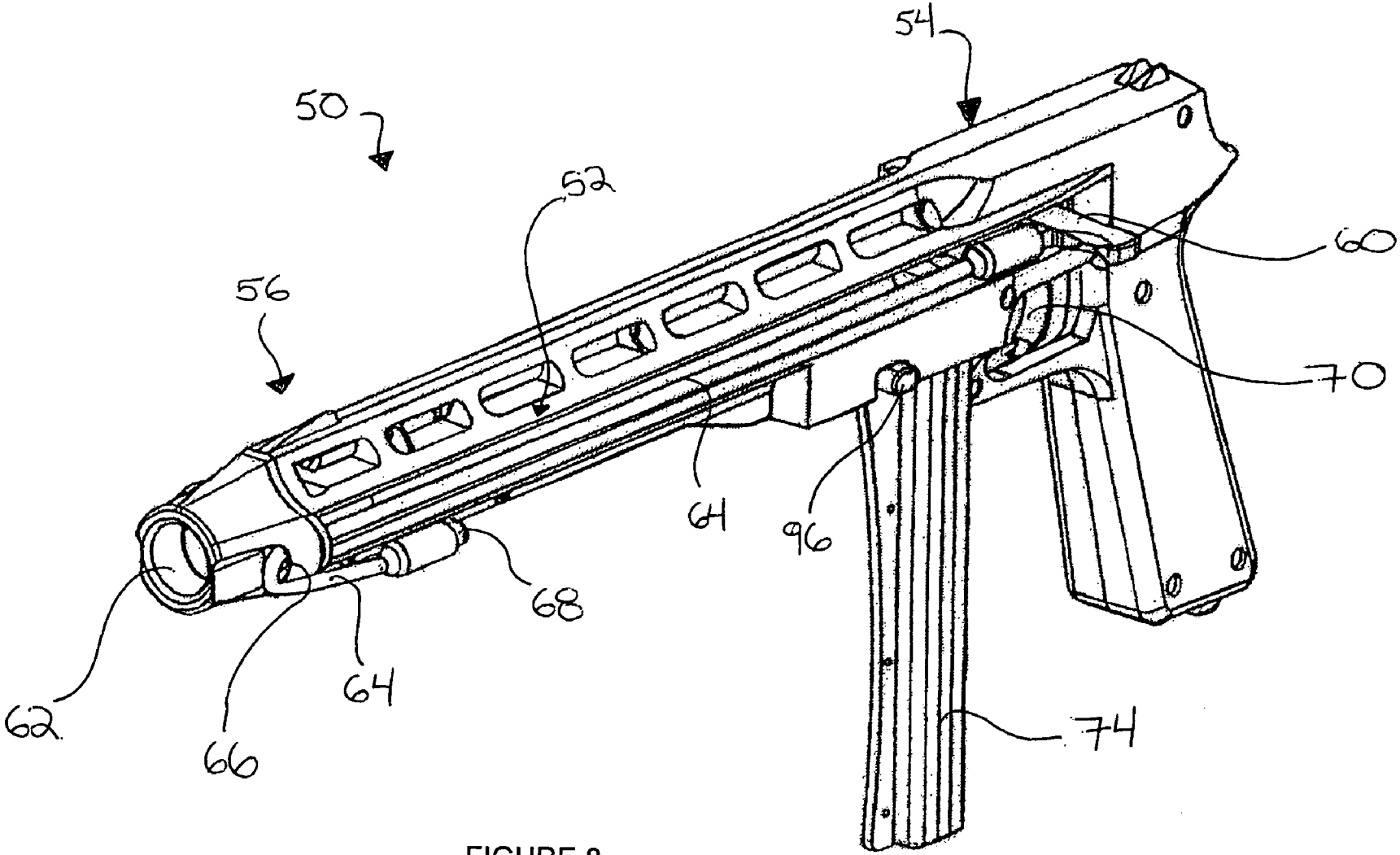
FIG. 8 is a top plan view of the gun according to FIG. 5.

Turning now to FIGS. 7 and 8, an alternate gun 50 is provided which can be used to shoot the projectiles 10 in place of the paintball gun of FIG. 4. The gun 50 includes a 68 caliber tubular barrel 52 having an internal diameter of 17 millimeters and extending from a loading end 54 to a dispensing end 56. A shuttle 58 is slidable within the internal diameter of the barrel and includes projections 60 extending externally of the barrel through respective longitudinal slots 61 along the barrel to permit gripping with a persons hand to move the shuttle within the barrels.

A cap 62 is mounted at the dispensing end 56 of the barrel and includes a through aperture therein in alignment with the hollow interior of the barrel for receiving projectiles therethrough.

A resilient band 64 couples to opposing sides of the shuttle 58 and extends through mounting apertures 66 on opposing sides of the cap. The resilient bands 64 are then anchored on opposing sides of the barrel externally therefrom at selected mounting points 68.

The mounting points 68 are provided at various spaced positions from the cap 62 such that the path that the resilient band follows from the shuttle in a cocked position adjacent the loading end of the barrel, through the cap 62 to the mounting points 68 can be adjusted to adjust the overall tension that the band applies to the shuttle to urge the shuttle towards the dispensing end in the cocked position.

A trigger mechanism 70 selectively holds the shuttle adjacent the loading end 54 in the cocked position.

A feed aperture 72 is provided in the barrel 52 adjacent the loading end but spaced between the shuttle and the dispensing end 56 in the cocked position of the shuttle. The feed aperture 72 is suitably sized for receiving one of the projectiles therethrough.

A magazine 74 couples to the feed aperture 72. The magazine comprises an elongate tube for receiving a plurality of projectiles in series therein. A loader 76 is slidably mounted within the chamber of the magazine in communication with a spring 77 which biases the loader and accordingly the projectiles therein towards the barrel through the feed aperture 72.

A blocker 78 is slidably mounted within the barrel between the shuttle 58 and the loading end 54 of the barrel. The blocker includes a stop member 80 which is slidably received in a slot 82 extending in the longitudinal direction of the barrel. A spring 84 is coupled to the blocker so that the blocker is urged towards the dispensing end of the barrel to cover the feed aperture as soon as the shuttle has passed thereacross to prevent entry of additional projectiles until the shuttle is returned to the cocked position subsequent to shooting a projectile from the barrel. The stop member 80 is arranged to reach a terminal end of the slot 82 when positioned above the feed aperture.

On opposing sides of the barrel adjacent the dispensing end 56 thereof, shuttle stop members 86 are provided which span across the path of the projections 60 of the shuttle as the shuttle is displaced towards the dispensing end 56. The shuttle stops 86 may each include resilient material which is resiliently deformed upon impact from the projections 60 of the shuttle when the gun is fired so as to minimize stressful impact of the shuttle at the dispensing end 56 of the barrel.

The magazine 74 is selectively separable from the gun body and barrel for replacing it with a replacement magazine 74 when more projectiles are required. The magazine includes a projectile retainer clip 90 which is slidable across an open top end of the magazine when the magazine is separated from the gun body to prevent projectiles from being released. A locking clip 92 is slidably supported adjacent the retainer clip 90 for selectively retaining the magazine on the gun body. The locking clip 92 is biasing into locking engagement with the gun body by a spring 94, but releasing the holding pin 96 against the force of the spring 94 permits the magazine to be separated from the gun body.

The projectiles 10 are designed for use in all standard 68 caliber paintball markers as well as for use in the specially designed non-air powered gun 50 described herein. The fibrous surface of the projectile tends to expand during the course of regular use. To prevent the projectile exceeding the internal diameter of the barrel thereby preventing it from passing freely through the barrel without compression, a lesser diameter of the projectile as manufactured is used to allow some expansion in use to remain less than the internal diameter of a 68 caliber barrel even after expansion. In the event that expansion occurs beyond the internal diameter of the barrel, the projectiles can make use of additional means for loading and aligning the projectiles within the barrel while being circumfrentially compressed. This is preferably avoided as the larger diameter projectiles would not be able to pass freely through the feed mechanism of a typical paintball gun without considerable modification or a new feed apparatus.

Therefore, the projectiles 10 are intentionally a slightly undersized projectile which will accommodate the expansion of surface fibers without exceeding the size of the internal diameter of the barrel and causing the balls to jam in a typical paintball gun loader.

Another advantage of the smaller sized projectile 10 is that it allows a certain amount of gas to blow past the ball when firing, thus significantly reducing the overall velocity. This is particularly advantageous in limiting the velocity even if the gun is tuned to its maximum setting. In addition, the smaller diameter contributes to a lighter weight which also helps in facilitating its use in a game where the projectiles are fired at participants wearing special velcro body armour and head gear or at closer range.

While some embodiments of the present invention have been described in the foregoing, it is to be understood that other embodiments are possible within the scope of the invention. The invention is to be considered limited solely by the scope of the appended claims.

The invention claimed is:

1. A projectile in combination with a compressed gas operated gun comprising a tubular barrel for receiving the projectile and a compressed gas release mechanism for propelling the projectile, the projectile comprising:

a spherical core; and a covering of material comprising one of hook or loop fasteners which surrounds the spherical core;

the projectile having an overall diameter, including the fasteners of the covering of material, without compression, which is less than an internal diameter of the tubular barrel of the gun such that a resultant gap surrounds the fasteners of the covering of material of the projectile within the barrel of the gun.

2. The combination according to claim 1 wherein the gun is configured for projecting 68 caliber projectiles.

3. The combination according to claim 1 wherein the covering of material comprises a plurality of sections extending generally radially from a common point, each section having a pair of opposing sides which are convex in profile and which converge at an apex at a free end of the respective section spaced from said common point, the sections being formed integrally of a single sheet of material forming an enclosed spherical shape in which the apexes are joined together.

4. The combination according to claim 1 wherein an overall diameter of the projectile is between 16 millimeters and 17 millimeters.

5. The combination according to claim 1 wherein an overall diameter of the core is between 10 millimeters and 12 millimeters.

6. The combination according to claim 5 wherein the overall diameter of the core is approximately 11 millimeters.

7. The combination according to claim 1 wherein weight of the projectile is between 0.8 grams and 1.4 grams.

8. The combination according to claim 7 wherein weight of the projectile is approximately 1.1 grams.

9. The combination according to claim 1 wherein the core has a solid interior and is formed of rigid material.

10. The combination according to claim 1 wherein the core has a solid interior and is formed of a dense, resilient material.

11. The combination according to claim 1 wherein the core has a hollow interior and is formed of a dense, resilient material.

12. The combination according to claim 1 wherein said gun comprises a paintball gun adapted for projecting dye-filled paintball projectiles.

13. The combination according to claim 12 wherein said gun comprises a paintball gun adapted for projecting dye-filled paintball projectiles wherein the barrel has an internal diameter of approximately 17 millimeters and the projectiles are loaded into the barrel by gravity feed.

* * * * *